US008864262B2

(12) United States Patent
Kobayashi

(10) Patent No.: US 8,864,262 B2
(45) Date of Patent: Oct. 21, 2014

(54) LIQUID EJECTING APPARATUS AND MANUFACTURING METHOD THEREOF

(71) Applicant: Seiko Epson Corporation, Tokyo (JP)

(72) Inventor: Haruki Kobayashi, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/744,763

(22) Filed: Jan. 18, 2013

(65) Prior Publication Data

US 2013/0187965 A1 Jul. 25, 2013

(30) Foreign Application Priority Data

Jan. 20, 2012 (JP) ..... 2012-010507

(51) Int. Cl.
*B41J 29/38* (2006.01)
*B41J 2/045* (2006.01)
*B41J 2/14* (2006.01)

(52) U.S. Cl.
CPC ..... *B41J 2/04588* (2013.01); *B41J 2/04553* (2013.01); *B41J 2/04581* (2013.01); *B41J 2/14233* (2013.01); *B41J 2002/14241* (2013.01); *B41J 2002/14419* (2013.01)
USPC ..... 347/10

(58) Field of Classification Search
USPC ..... 347/10; 29/25.35; 252/62.9 R
See application file for complete search history.

(56) References Cited

U.S. PATENT DOCUMENTS

| | | | | |
|---|---|---|---|---|
| 7,033,521 | B2 | 4/2006 | Iwashita et al. | |
| 2010/0259574 | A1* | 10/2010 | Sumi | 347/10 |
| 2011/0102518 | A1* | 5/2011 | Yonemura et al. | 347/71 |

FOREIGN PATENT DOCUMENTS

| | | |
|---|---|---|
| JP | 2004-006722 | 1/2004 |
| JP | 2010-247404 | 11/2010 |

* cited by examiner

*Primary Examiner* — Lisa M Solomon
(74) *Attorney, Agent, or Firm* — Harness, Dickey & Pierce, P.L.C.

(57) ABSTRACT

A liquid ejecting apparatus includes a correction section maintains a predetermined voltage range in which a displacement is greater than a predetermined ratio as a drive voltage range from a relationship between each voltage and the displacement when a reference waveform having a process that changes the voltage from a first voltage to a second voltage having a voltage difference and a process that changes the voltage from the second voltage to the first voltage is supplied by making the voltage difference between the first voltage and the second voltage constant and changing the first voltage and the second voltage, and wherein the correction section changes the drive waveform into a drive waveform having a minimum voltage and a maximum voltage defined within the drive voltage range.

1 Claim, 7 Drawing Sheets

LIQUID EJECTING APPARATUS AND MANUFACTURING METHOD THEREOF

The entire disclosure of Japanese Patent Application No. 2012-010507, filed Jan. 20, 2012 is incorporated by reference herein.

BACKGROUND

1. Technical Field

The present invention relates to a liquid ejecting apparatus including a piezoelectric element having an electrode and a piezoelectric layer that generate a pressure change in a pressure generating chamber communicating with nozzle openings and to a manufacturing method thereof.

2. Related Art

As a representative example of a liquid ejecting head mounted on a liquid ejecting apparatus, there is an ink jet type recording head in which a portion of a pressure generating chamber communicating with nozzle openings from which ink droplets are discharged is configured by a vibration plate, and which discharges an ink as the ink droplets from the nozzle openings by deforming the vibration plate using a piezoelectric element and pressurizing the ink within the pressure generating chamber.

The piezoelectric element used in the liquid ejecting head has a configuration in which a piezoelectric material with an electrical-mechanical conversion function, for example, a piezoelectric layer made of a crystallized dielectric material is interposed between two electrodes. Such a piezoelectric element is mounted on the liquid ejecting head as an actuator device of a flexure vibration mode. Herein, as a representative example of the liquid ejecting head, for example, there is the ink jet type recording head in which a portion of the pressure generating chamber communicating with the nozzle openings from which the ink droplets are discharged is formed of the vibration plate, and which discharges the ink as the ink droplets from the nozzle openings by deforming the vibration plate using the piezoelectric element and pressurizing the ink within the pressure generating chamber.

The piezoelectric material used as a piezoelectric layer configuring such a piezoelectric element requires a high piezoelectric properties and as the representative example of the piezoelectric material, there is lead zirconate titante (PZT). However, a piezoelectric material (non-lead piezoelectric material) which is obtained by removing or suppressing the content of lead has been required from the viewpoint of environmental problems. As the piezoelectric material that does not contain lead, for example, a material having a perovskite crystal structure of barium titanate has been suggested (for example, see JP-A-2004-6722). In addition, as the piezoelectric material that is obtained by suppressing the content of lead, for example, a mixed crystal material of non-lead piezoelectric material and PZT base material is exemplified.

The piezoelectric material made barium titanate series has been primarily considered as the piezoelectric material in bulk, but has not been much considered as a thin film formed on a substrate by a chemical solution method or a sputtering method. Since the piezoelectric layer made of a complex oxide that is obtained by removing or suppressing content of lead does not have a sufficient displacement amount compared with lead zirconate titanate (PZT), it is necessary to have an improved displacement amount and a stable drive.

Such a problem occurs in not only the ink jet type recording head but also in other liquid ejecting heads discharging droplets other than ink. In addition, such a problem also occurs in the piezoelectric element used in addition to the liquid ejecting head.

SUMMARY

An advantage of some aspects of the invention is to provide a liquid ejecting apparatus having a low environmental load and a stable displacement amount and a manufacturing method thereof.

According to a first aspect of the invention, there is provided a liquid ejecting apparatus including: a piezoelectric element that has a piezoelectric layer made of non-lead complex oxide and an electrode provided at the piezoelectric layer; and a correction section that controls a drive waveform which is supplied to the piezoelectric element, wherein the correction section maintains a predetermined voltage range in which displacement is greater than a predetermined ratio as a drive voltage range from a relationship between each voltage and the displacement when a reference waveform having a process that changes the voltage from a first voltage to a second voltage having a voltage difference and a process that changes the voltage from the second voltage to a first voltage is supplied by making the voltage difference between the first voltage and the second voltage constant and by changing the first voltage and the second voltage, and wherein the correction section changes the drive waveform into a drive waveform having a minimum voltage and a maximum voltage defined within the drive voltage range.

In this aspect, the voltage dependence of the displacement amount of the piezoelectric element is apprehended in advance and thus a predetermined drive voltage range is specified. For example, when the correction section changes the drive voltage according to deterioration of the piezoelectric element or variations in an ambient temperature, by changing the drive voltage into the drive waveform defined within the drive voltage range, the liquid ejecting apparatus having a stable displacement amount may be realized.

It is preferable that the drive voltage range be a predetermined voltage range which is determined from a first threshold voltage and a second threshold voltage by setting the first voltage and the second voltage as the first threshold voltage and the second threshold voltage, when displacement is decreased only at a predetermined ratio from a maximum displacement by measuring the displacement for each voltage when the reference waveform is supplied by making the voltage difference constant and changing the first voltage and the second voltage. According to this, since the change in the displacement amount with respect to the voltage change is maintained within the predetermined ratio, the liquid ejecting apparatus having a stable displacement amount may be realized.

In addition, a voltage range from a minimum voltage to a maximum voltage when the reference waveform of which the first voltage is a relatively low voltage is supplied may be set as a first voltage range, and in contrast the voltage range from the minimum voltage to the maximum voltage when the reference waveform of which the first voltage is a relatively high voltage is supplied may be set as a second voltage range. The voltage range in which the first voltage range and the second voltage range are superimposed on each other may be set as the predetermined voltage range. According to this, even if the drive waveform defined at a relatively low voltage with respect to the reference voltage is used, the stable displacement amount is maintained.

According to a second aspect of the invention, there is provided a manufacturing method of a liquid ejecting apparatus including a piezoelectric element that has a piezoelectric layer made of non-lead complex oxide and an electrode provided at the piezoelectric layer; and a drive section that supplies a drive waveform driving the piezoelectric element to the piezoelectric element. The method includes: setting a predetermined voltage range in which a displacement is greater than a predetermined rate as a drive voltage range from a relationship between each voltage and the displacement when the reference waveform having a process that changes a voltage from a first voltage to a second voltage having a voltage difference and a process that changes the voltage from the second voltage to the first voltage is supplied by making the voltage difference constant and changing the first voltage and the second voltage; and setting the drive waveform which the drive section supplies to the piezoelectric element as a drive waveform defined in a minimum voltage and a maximum voltage defined within in the drive piezoelectric range.

In this aspect, in such a manner that the voltage dependence of the displacement amount of the piezoelectric element is apprehended in advance, a predetermined drive voltage range is specified and a drive waveform which is supplied to each piezoelectric element is set to be a drive waveform defined as the drive voltage range, the liquid ejecting apparatus having a stable displacement amount may be manufactured.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1:
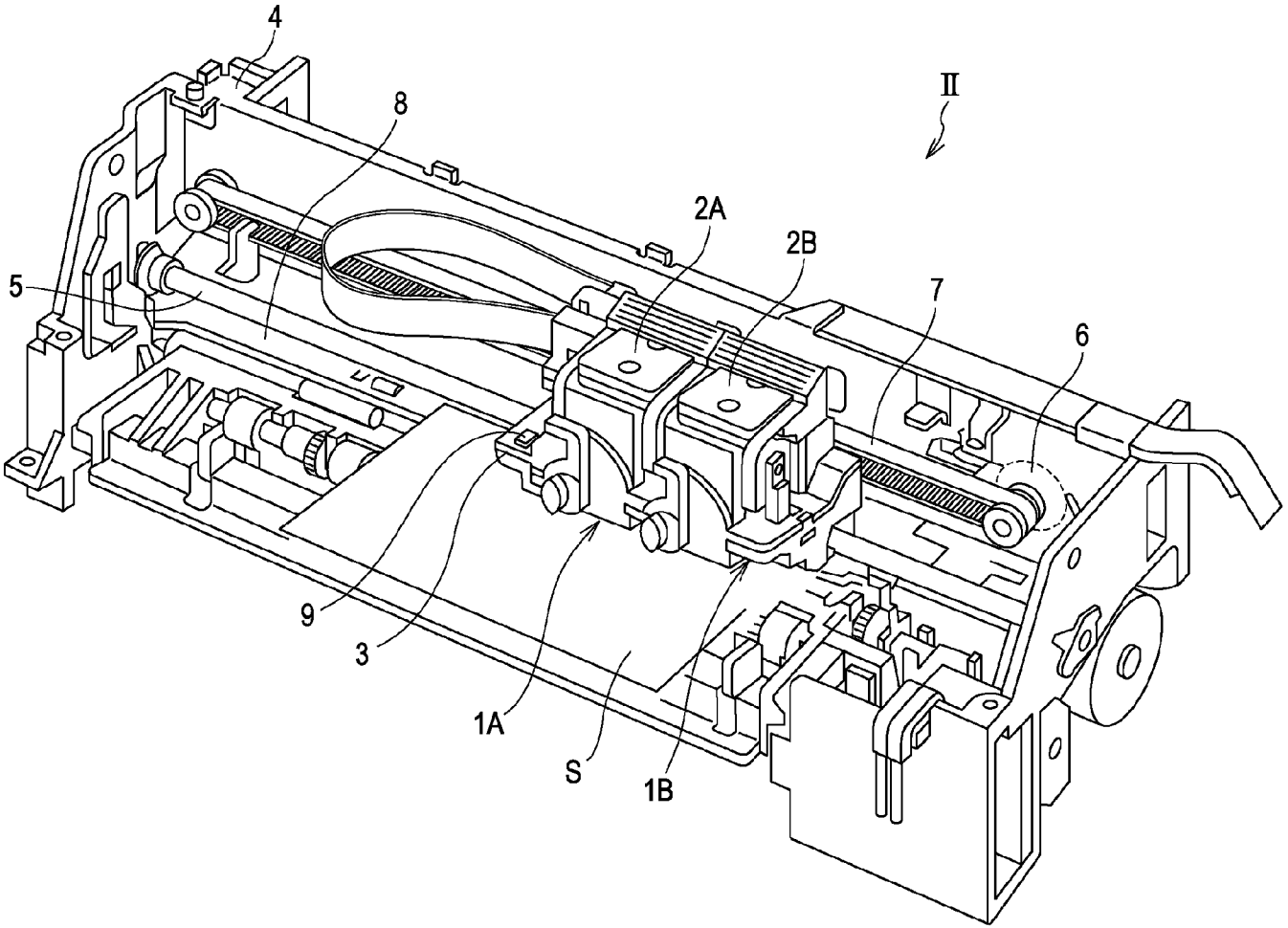
FIG. 1 is a view illustrating a schematic configuration of an ink jet type recording apparatus according to an embodiment of the invention.

FIG. 1 is a schematic view illustrating an example of an ink jet type recording apparatus that is an example of a liquid ejecting apparatus according to the invention. As illustrated in FIG. 1, in the in ink jet type recording apparatus II, recording head units 1A and 1B configuring ink type jet recording heads are provided for cartridges 2A and 2B including ink supply means to be attachable and detachable, and a carriage 3 which is equipped with the recording head units 1A and 1B is provided to be axially movable, on a carriage shaft 5 attached to an apparatus main body 4. For example, the recording head units 1A and 1B respectively discharge black ink composition and color ink composition.

Therefore, since the drive force of a drive motor 6 is transmitted to the carriage 3 via a plurality of gears (not illustrated) and a timing belt 7, the carriage 3 equipped with the recording head units 1A and 1B is moved along the carriage shaft 5. Meanwhile, an apparatus main body 4 is provided with a platen 8 along the carriage shaft 5 and a recording sheet S that is a recording medium such as a sheet of paper fed by a paper feeding roller (not illustrated) is wound around a platen 8 to be transported.

In addition, the carriage 3 is provided with a temperature sensor 9 for measuring the temperature of the recording head units 1A and 1B. In the present embodiment, the temperature sensor 9 is configured by a thermostat.

Herein, the ink jet type recording head mounted in an ink jet type recording apparatus II will be described with reference to FIGS. 2 to 4. In addition, FIG. 2 is an exploded perspective view illustrating a schematic configuration of the ink jet type recording head that is an example of a liquid ejecting apparatus according to the first embodiment of the invention, FIG. 3 is a plan view of FIG. 2 and FIG. 4 is a cross-sectional view taken along the line IV-IV of FIG. 3.

Figure 2:
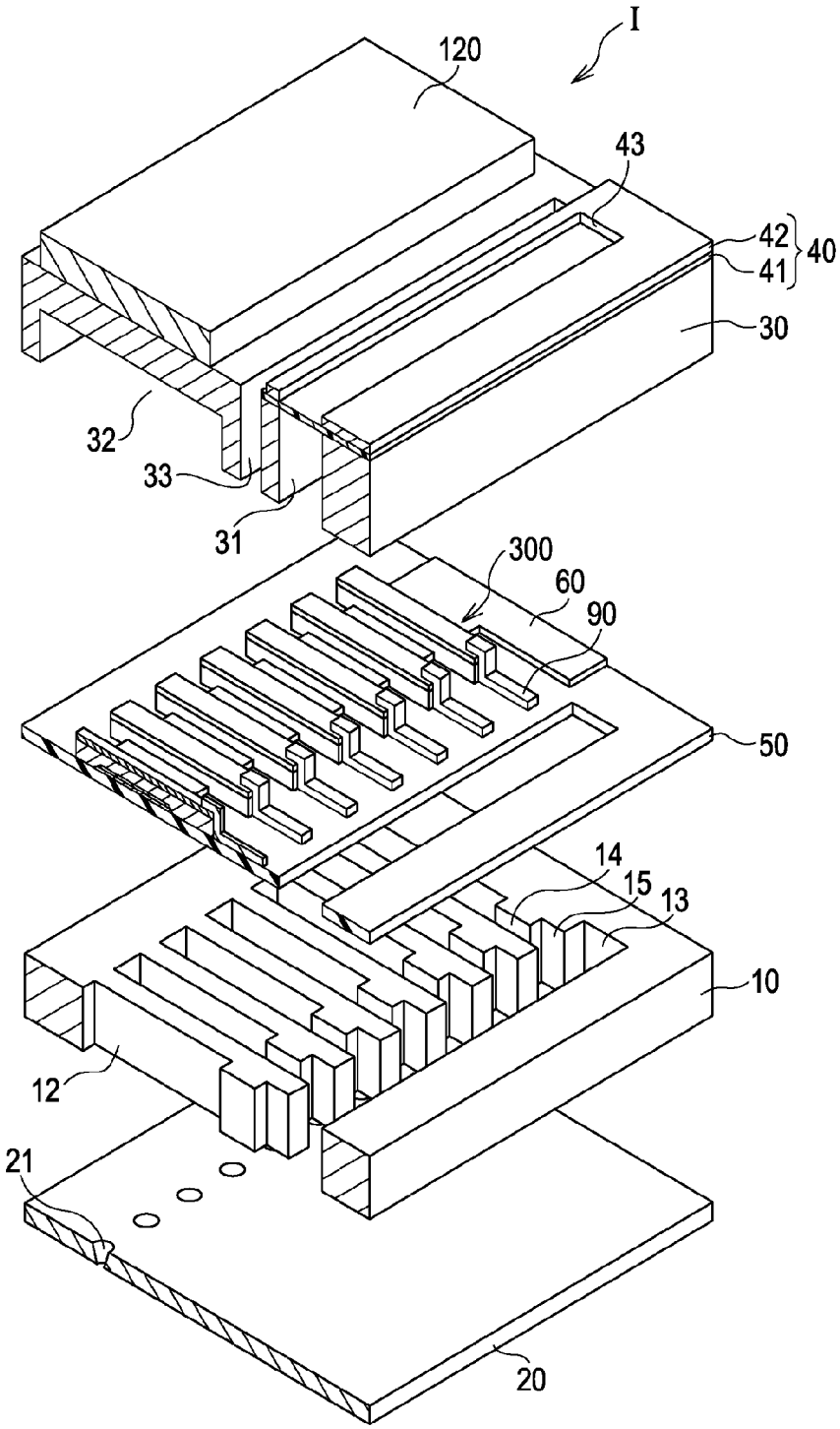
FIG. 2 is an exploded perspective view illustrating a schematic configuration of a recording head according to a first embodiment.
Figure 3:
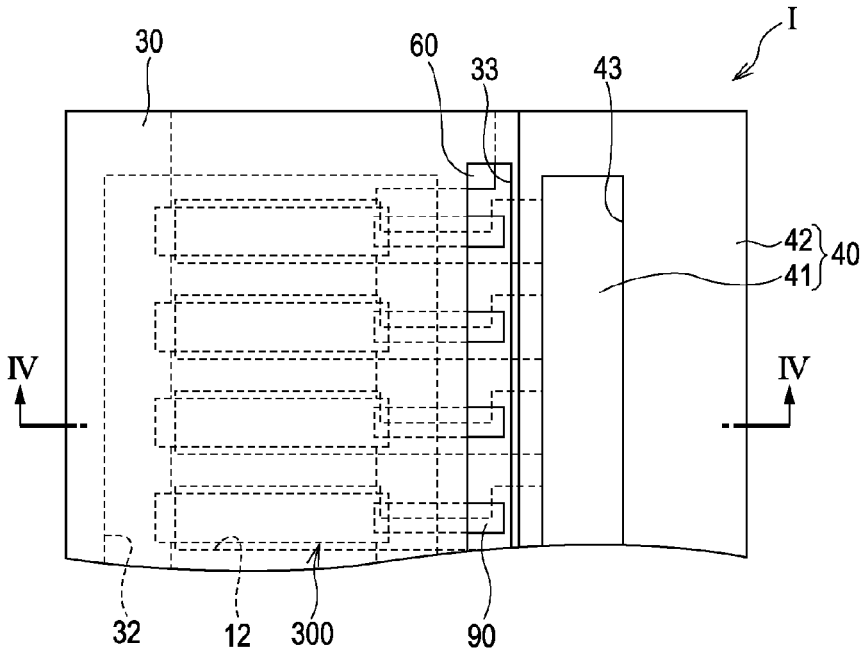
FIG. 3 is a plan view of a recording head according to a first embodiment.
Figure 4:
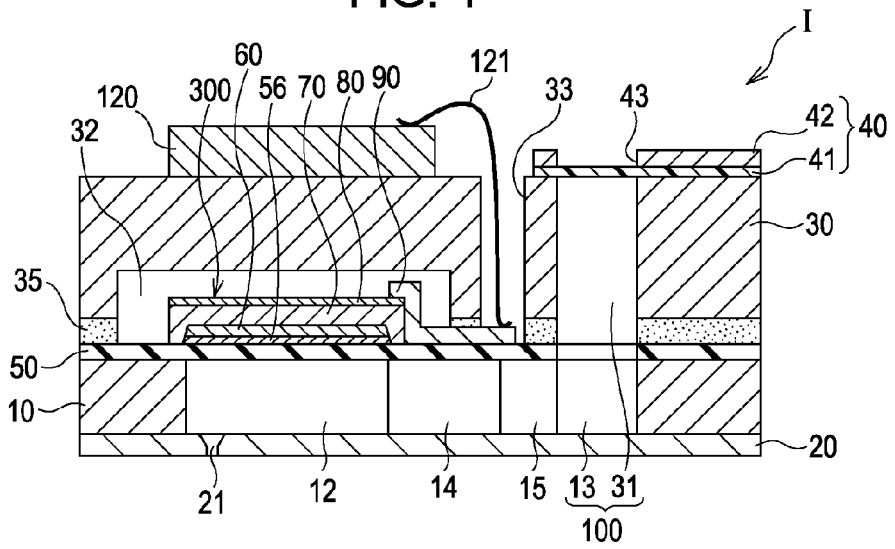
FIG. 4 is a cross-sectional view of a recording head according to a first embodiment.

As illustrated in FIGS. 2 to 4, a flow path forming substrate 10 of the embodiment is a signal crystalline silicon substrate and on one surface thereof is formed with an elastic film 50 made of silicon dioxide.

The flow path forming substrate 10 has a plurality of pressure generating chambers 12 juxtaposed in the width direction thereof. In addition, an area outside the pressure generating chamber 12 of the flow path forming substrate 10 in the longitudinal direction is formed with a communication section 13, and the communication section 13 and each of the pressure generating chambers 12 are communicated with each other via an ink supply path 14 provided for each of the pressure generating chambers 12 and the communication section 15. The communication section 13 configures a portion of a manifold that serves as a common ink chamber of each of the pressure generating chambers 12 by communicating with a manifold section 31 of a protective substrate described below. The ink supply path 14 is formed to have a narrower width than that of the pressure generating chambers 12 and constantly maintains the flow path resistance of the ink flowing into the pressure generating chambers 12 from the communication section 13. In addition, in the embodiment, the ink supply path 14 is formed by narrowing the width of the flow path from one side thereof, but the ink supply path may be formed by narrowing the width of the flow path from both sides thereof. In addition, instead of narrowing the width of the flow path, the ink supply path may be formed by narrowing the width of the flow path from the thickness direction. In the embodiment, the flow path forming substrate 10 is formed with a liquid flow path including the pressure generating chamber 12, the communication chamber 13, the ink supply path 14 and the communication path 15.

In addition, a nozzle plate 20 having a drilled opening 21 communicating with the end vicinity of the opposite side to the ink supply path 14 of each pressure generating chamber 12 is fixedly attached to an opening surface side of the flow path forming substrate 10 using an adhesive or a heat welding film or the like. In addition, for example, the nozzle plate 20 is made of a glass ceramic, a single silicon crystalline substrate, stainless steel and the like.

Meanwhile, the opposite side to the opening surface of the flow path forming substrate 10 is formed with an elastic film 50 as described above, for example, titanium oxide of a thickness of 30 to 50 nm is formed on the elastic film 50 and is provided with an adhesive layer 56 for improving the adhesion to a base of a first electrode 60 of the elastic film 50 and the like. In addition, an insulator film made of zirconium oxide or the like may be provided on the elastic film 50 when necessary.

Further, a first electrode 60, a piezoelectric layer 70 that is a thin film having a thickness of 3 μm or less, preferably 0.3 to 1.5 μm, and a second electrode 80 are laminated on the adhesion layer 56 to configure a piezoelectric element 300 as pressure generating means which generates a pressure change in the pressure generating chambers 12. Herein, piezoelectric element 300 represents a portion including the first electrode 60, a piezoelectric layer 70 and the second electrode 80. Generally, any one electrode of the piezoelectric element 300 is set as a common electrode, and the other electrode and the piezoelectric layer 70 are patterned for each of the pressure generating chambers 12 to configure the piezoelectric element 300. In the embodiment, the first electrode 60 is set as the common electrode of the piezoelectric element 300 and the second electrode 80 is set as an individual electrode of the piezoelectric element 300. However, there is no problem even if this is reversed for convenience of a drive circuit or wiring. In addition, a combination of the piezoelectric element 300 and the vibration plate on which a displacement is generated due to the drive of the piezoelectric element 300 is referred to as an actuator device. In addition, in the example described above, the elastic film 50, the adhesion layer 56, the first electrode 60 and the insulator film provided when necessary act as the vibration plate, but are not limited to thereto, of course. For example, the elastic film 50 or the intimate adhesive layer 56 may be not provided. In addition, the piezoelectric element 300 itself may substantially serve as the vibration plate.

In addition, in the embodiment, the piezoelectric material configuring the piezoelectric layer 70 is made of barium titanate-based complex oxide. The piezoelectric material is an oxide having a perovskite structure containing titanium, barium, but may be one where a portion of barium of an A site is replaced with Sr or Ca or the like or one where a portion of titanium of a B site is replaced with Zr or Hf. In addition, as a barium titanate-based composite oxide, in addition to one where a portion of the barium titanate, the barium and titanium is replaced with the other element, another where a perovskite type piezoelectric material containing no lead is dissolved and solidified. The perovskite type piezoelectric material dissolved to and solidified barium titanate or the replaced portion thereof may include a piezoelectric material of bismuth sodium titanate, alkaline niobium and bismuth ferrate.

It was discovered that the piezoelectric material used in the invention, in particular, bismuth titanate has a voltage dependence of the displacement amount in which the displacement amount is greatly changed due to the voltage range that is actually driven. That is, in a PZT, it was confirmed that even if the operating voltage range is changed, the change amount of in the displacement amount with respect to the amount of voltage change is substantially constant, whereas the non-lead piezoelectric material described above has an area in which the amount of change in the displacement amount with respect to a piezoelectric change amount is greatly changed when the voltage range is changed, and the area is changed for each manufactured piezoelectric element.

Therefore, it is necessary to ascertain the drive voltage range optimized for each manufactured liquid ejecting head and to set the drive voltage range optimized for each head to be in the driven range using a drive waveform defined within the drive voltage range.

In addition to the initially set drive waveform, for example, when the drive voltage is changed by the ambient temperature and correction is performed which changes the drive voltage according to a state of degradation due to the use, it is necessary to define the drive waveform after the correction within the drive voltage range in consideration of the drive voltage range described above.

A lead electrode 90 which is withdrawn from the vicinity of the end of the ink supply path 14 side and is extended up to the elastic film 50 or up the insulator film provided when necessary and which is made of Au and the like, for example, is connected to each second electrode 80 that is an individual electrode of the piezoelectric element 300.

The protective substrate 30 having a manifold section 31 configuring at least a portion of a manifold 100 is bonded using an adhesive 35, on the flow path substrate 10 on which the piezoelectric element 300 is formed, that is, on the first electrode 60, the elastic film 50, the insulator film provided when necessary and the lead electrode 90. In the embodiment, the manifold section 31 is formed along the width direction of the pressure generating chamber 12 passing through the protective substrate 30 in the thickness direction, and configures the manifold 100 that serves as a common ink chamber of each pressure generating chamber 12 by communicating with the communication section 13 of the flow path forming substrate 10 as described above. In addition, only the manifold section 31 may be set as the manifold by dividing the communication section 13 of the flow path forming substrate 10 into the plurality for each pressure generating chamber 12. Furthermore, for example, it is preferable that only the pressure generating chamber 12 be provided on the flow path forming substrate 10 and the ink supply path 14 communicating with the manifold 100 and each pressure generating chamber 12 may be provided on a member (for example, the elastic film 50, the insulator film provided when necessary) interposed between the flow path forming substrate 10 and the protective substrate 30.

A piezoelectric element holding section 32 having a space which does not hinder the movement of the piezoelectric element 300 is provided on the area opposing the piezoelectric element 300 of the protective substrate 30. The piezoelectric element holding section 32 may have a space which does not hinder the movement of the piezoelectric element 300 and the space may be sealed or may not be sealed.

As the protective substrate 30 use it is preferable to the material having substantially the same coefficient of thermal expansion as that of the flow path forming substrate 10, for example, glass, ceramic material and the like. In this embodiment, the protective substrate 30 is formed using a single silicon crystalline substrate which is the same material as the flow path forming substrate 10.

In addition, the protective substrates 30 is provided with a through hole 33 passing through the protective substrate 30 in the thickness direction. Then, the vicinity of the end portion of the lead electrode 90 withdrawn from each piezoelectric element 300 is exposed inside the through hole 33.

In addition, a drive circuit 120 for driving a juxtaposed piezoelectric element 300 is fixed onto the protective substrate 30. As this driving circuit 120, for example, a circuit substrate or a semiconductor integrated circuit (IC) and the like can be used. Then, the drive circuit 120 and the lead electrode 90 are electrically connected to each other via a connection wiring 121 formed of a conductive wire such as bonding wire.

In addition, a compliance substrate 40 formed of a sealing film 41 and a fixing plate 42 is bonded on such a protective substrate 30. Herein, the sealing film 41 is made of a material having flexibility and low rigidity, and one surface of the manifold section 31 is sealed by the sealing film 41. In addition, the fixing plate 42 is formed from a relatively hard material. Since the area opposing the manifold 100 of the fixing plate 42 has an opening 43 which is completely removed in the thickness direction, one surface of the manifold 100 is sealed only by the sealing film 41 having flexibility.

In the ink jet type recording head I of the embodiment, the ink from an ink is brought from an introduction port connected to an external ink supply means (not illustrated), the interior from the manifold 100 to the nozzle opening 21 is filled and then a voltage is applied between the respective the first electrode 60 and the second electrode 80 corresponding to the pressure generating chamber 12 in response to a recording signal (drive signal) from the drive circuit 120, and the elastic film 50, the adhesion layer 56, the first electrode 60 and the piezoelectric layer 70 are bent and deformed. In this manner, the pressure within each pressure generating chamber 12 is increased and thus the ink droplet is discharged from the nozzle opening 21.

Figure 5:
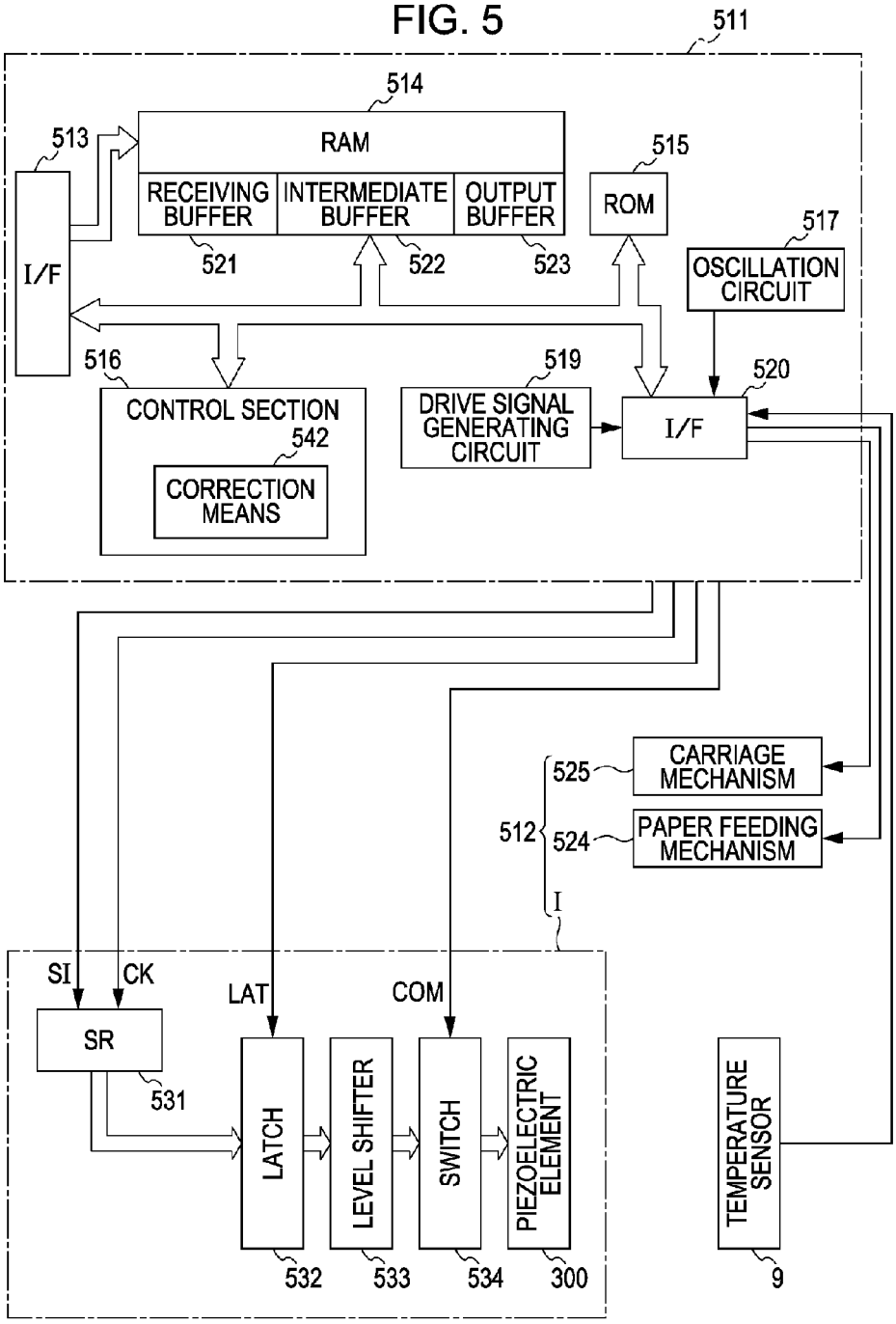
FIG. 5 is a block diagram illustrating a control configuration of an ink jet recording apparatus according to a first embodiment.

FIG. 5 is a block diagram illustrating an example of a control configuration of such an ink jet type recording apparatus. Control of the ink jet type recording apparatus of the embodiment will be described with reference to FIG. 5. The ink jet type recording apparatus of the embodiment has a schematic configuration including a print controller 511 and a print engine 512 as illustrated in FIG. 5. The print controller 511 includes an external interface 513 (hereinafter, referred to as an external I/F 513), a RAM 514 that temporarily stores various data, a ROM 515 that stores a control program and the like, a control section 516 that has a CPU and the like, an oscillation circuit 517 that generates a clock signal, a drive signal generating circuit 519 that generates a drive signal supplied to the ink jet type recording head I and an internal interface 520 (hereinafter, referred to as an internal I/F 520) that transmits dot pattern data (bitmap data) and the like deployed based on the drive signal or print data, to a print engine 512.

The external I/F 513, for example, receives the print data including a character code, a graphic function and image data and the like from a host computer (not illustrated). In addition, a busy signal (BUSY) or an acknowledgement signal (ACK) is output to the host computer and the like through the external I/F 513. The RAM 514 functions as a receiving buffer 521, an intermediate buffer 522, an output buffer 523 and a work memory (not illustrated). Then, the receiving buffer 521 temporarily stores the print data received by the external I/F 513, the intermediate buffer 522 stores intermediate code data converted by the control section 516 and the output buffer 523 stores the dot pattern data. In addition, the dot pattern data is configured by the print data obtained by decoding (translating) gradation data.

The ROM 515 stores the font data, the graphic function and the like in addition to the control program (control routine) for performing various data process.

The control section 516 reads out the print data within the receiving buffer 521 and controls the intermediate buffer 522 to store the intermediate code data obtained by converting the print data. In addition, in the control section 516, the intermediate code data is deployed into the dot pattern data by analyzing the intermediate code data read out from the intermediate buffer 522 and referring to the font data and the graphic function and the like stored in the ROM 515. In addition, the control section 516 performs a required decoration treatment and then controls the output buffer 523 to store the deployed dot pattern data. In addition, the control section 516 also functions as a waveform setting means and sets a waveform shape of the drive signal generated from the drive signal generating circuit 519 by controlling the drive signal generating circuit 519. The control section 516 configures the drive means of the invention together with the drive circuit (not illustrated) and the like. In addition, the liquid ejecting drive apparatus which drives the ink jet type recording head I may have at least the drive means. In the embodiment, the drive means including the printer controller 511 is exemplified.

In addition, if dot pattern data corresponding to one row of the ink jet type recording head I is obtained, the dot pattern data of the one row is output to the ink jet type recording head I through the internal I/F 520. In addition, if the dot pattern data of the one row is output from the output buffer 523, the deployed intermediate code data is erased from the intermediate buffer 522 and the deployment process is performed with regard to the next intermediate code data.

The print engine 512 includes the ink jet type recording head I, a paper feeding mechanism 524 and a carriage mechanism 525. The paper feeding mechanism 524 is configured by the paper feeding motor, the platen 8 and the like and sequentially feeds the print recording medium such as the recording paper being interlocked with the recording operation of the ink jet type recording head I. That is, the paper feeding mechanism 524 relatively moves the print recording medium in the sub-scanning direction.

The carriage mechanism 525 includes a carriage 3 that can mount the ink jet type recording head I and a carriage driving section that causes the carriage 3 to travel along the main scanning direction, and moves the ink jet type recording head I in the main scanning direction by causing the carriage 3 to travel. In addition, the carriage drive section includes the drive motor 6 and the timing belt 7 and the like, as described above.

The ink jet type recording head I has multiple nozzle openings 21 along the sub-scanning direction and discharges a droplet from each nozzle opening 21 at the timing defined by the dot pattern data and the like. Then, the piezoelectric element 300 of such an ink jet type recording head I is supplied with an electrical signal, for example, a drive signal (COM) or recording data (SI) described below, via the external wiring (not illustrated). The printer controller 511 and the print engine 512 configured in this manner includes drive means in which the printer controller 511 and a drive circuit (not illustrated) having a latch 532, a level shifter 533 and a switch 534 and the like that selectively input the drive signal having a predetermined waveform output from a drive signal generating circuit 519 to the piezoelectric element 300 apply a predetermined drive signal to the piezoelectric element 300.

In addition, the shift register (SR) 531, latch 532, level shifter 533 and switch 534 and piezoelectric element 300 are respectively provided for each nozzle opening 21 of the ink jet type recording head I and these shift register 531, latch 532, level shifter 533 and switch 534 generate the drive pulse from the discharge drive signal or a relaxation drive signal which the drive signal generating circuit 519 generates. Herein, the drive pulse means is an applying pulse actually applied to the piezoelectric element 300.

As the drive waveform which becomes the discharge drive signal, the respective standard drive waveforms for the large dot, for the medium dot and the small dot are supplied usually, and these drive waveforms are set to be defined within a predetermined drive voltage range determined as described below. In addition, for example, the drive waveform for correction used in the case where a sufficient displacement amount cannot be obtained due to the low environmental temperature can be formed, but the drive waveform for correction is also set to be defined within a predetermined drive voltage range.

In addition, there is correction means 542 that performs a supply control of the drive waveform in this manner. When the correction means 542 obtains the temperature information from the temperature sensor 9 and for example, this temperature within a predetermined range, the correction means 542 controls the drive signal generating circuit 519 in order to produce the drive waveform for the correction. This will be described in detail later.

In such an ink jet type recording head I, the recording data (SI) which is initially synchronized with the clock signal (CK) from the oscillation circuit 517 and which configures the dot pattern data is serially transmitted to the shift register 531 from the output buffer 523 to be sequentially set. In this case, first, the data of the most signification bits in the print data of all the nozzle openings 21 is serially transmitted and if serial transmission of data of the most signification bits is completed, the data of the second order bit from the top is serially transmitted. Similarly, the data of the low order bit is sequentially and serially transmitted.

Further, if all the nozzle portions of the recording data of the bit are set in each shift register 531, the control section 516 outputs the latch signal (LAT) to the latch 532 at a predetermined timing. By this latch signal, the latch 532 latches the print data set in the shift register 531. The recording data (LATout) latched by the latch 532 is applied to the level shifter 533 that is the voltage amplifier. For example, the recording data is "1", the level shifter 533 boosts the recording data up to the voltage value in which the switch 534 is drivable, that is, up to several tens of voltage. Then, the boosted recording data is applied to each switch 534 and each switch 534 is in the connected state with each other by the recording data.

In addition, a drive signal (COM) generated by the drive signal generating circuit 519 is also applied to each switch 534 and when the switch 534 is selectively in the connected state, the drive signal is selectively applied to the piezoelectric element 300 connected to the switch 534. In this manner, the ink jet type recording head I exemplified can control whether the discharge drive signal is applied to the piezoelectric element 300 depending on the recording data. For example, since the switch 534 is in the connected state in the period that the recording data is "1" by the latch signal (LAT), the drive signal (COMout) can be supplied to the piezoelectric element 300 and the piezoelectric element 300 is displaced (deformed) by the supplied drive signal (COMout). In addition, since the switch 534 is in a disconnected state in the period in which the recording data is "0", a supply of the drive signal to the piezoelectric element 300 is blocked. Each piezoelectric element 300 holds the immediately previous potential in the period in which the recording is "0" and thereby the immediately previous displacement state is maintained.

In addition, the above-described piezoelectric element 300 is a piezoelectric element 300 of a deflecting vibration mode. When the piezoelectric element 300 of the deflecting vibration mode is used, the piezoelectric element 300 and the vibration plate are deflected to the pressure generating chamber 12 side since the piezoelectric layer 70 is contracted in the vertical direction to the voltage (in the direction 31) in response to the applied voltage, and thereby the pressure generating chamber 12 is contracted. In contrast, the piezoelectric element 300 and the vibration plate are deflected to the opposite side of the pressure generating chamber 12 since the piezoelectric layer 70 is extended in the direction 31 by reducing the voltage, thereby the pressure generating chamber 12 is expanded. Since the corresponding volume of the pressure generating chamber 12 is changed in response to the charging and discharging with respect to the piezoelectric element 300, the droplet can be discharged from the nozzle opening 21 using the pressure variations of the pressure generating chamber 12.

Herein, a drive waveform illustrating a drive signal (COM) of the embodiment, which is input to the piezoelectric element 300 will be described. In addition, FIG. 6 is the drive waveform illustrating the drive signal of the embodiment.

The drive waveform input to the piezoelectric element 300 is applied to an individual electrode (second electrode 80) by setting a common electrode (first electrode 60) to be a reference voltage (Vbs in the embodiment). That is, the voltage applied to the individual electrode (second electrode 80) depending on the drive waveform is illustrated with reference to shows the reference potential (Vbs).

Figure 6:
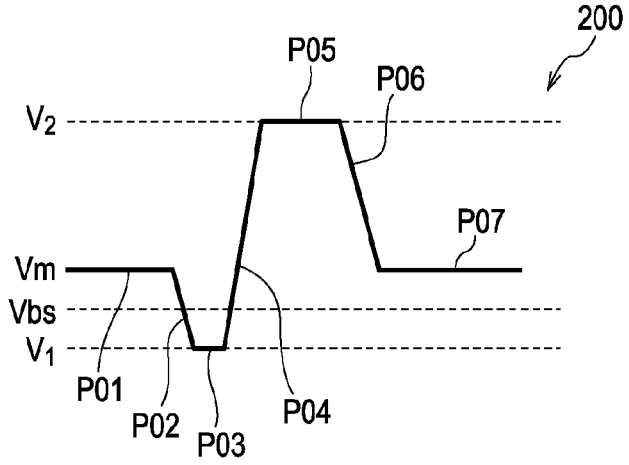
FIG. 6 is a view illustrating an example of a drive signal (drive waveform) according to a first embodiment.

As illustrated in FIG. 6, when the drive waveform which is in a preparing state to inputs the drive waveform 200 an example of the embodiment becomes a reference state (drive standby state), the drive waveform is in a state where an intermediate potential Vm is applied. The drive waveform includes a standby process P01 holding the intermediate potential Vm and then a first voltage change process P02 which expands the pressure generating chamber 12 by dropping the potential from the state which holds the intermediate potential Vm to a minimum potential $V_1$ of the opposite polarity to the intermediate voltage, a first hold process P03 which holds the minimum potential $V_1$ during a constant period, a second voltage change process P04 which contracts the pressure generating chamber 12 by boosting the potential from the minimum potential $V_1$ to the maximum potential $V_2$ of opposite polarity to the minimum potential $V_1$, a second holding process P05 which maintains the maximum potential $V_2$ during the constant period, a third voltage change process P06 which expands the pressure generating chamber 12 by dropping the potential from the maximum potential $V_2$ to the intermediate potential Vm and a standby process P07 which holds the intermediate potential Vm.

When such a drive waveform 200 is supplied to the piezoelectric element 300 to be driven, the state of the change in the amount of displacement is displaced depending on the potential of the minimum voltage $V_1$ and the maximum voltage $V_2$. That is, the piezoelectric element is made of a PZT, the amount of displacement is not significantly changed even if the potential between the minimum voltage $V_1$ and the maximum voltage $V_2$ is made identical to each other and the potential between the minimum voltage $V_1$ and the maximum voltage $V_2$ is increased or decreased. However, if the piezoelectric element 300 is made of a non-lead complex oxide, for example, if the piezoelectric element is made of barium titanate as the embodiment, when the voltage difference between the minimum voltage $V_1$ and the maximum voltage $V_2$ is made identical and the potential between the minimum voltage $V_1$ and the maximum voltage $V_2$ is increased or decreased, the amount of the displacement is significantly changed. Accordingly, it is understood that the area is changed depending on the manufacturing conditions of the piezoelectric element 300 and the like.

Therefore, before the piezoelectric element 300 of the embodiment is mounted on the ink jet type recording head I, a test is performed to determine the drive voltage range that is stable and optimal, and the drive waveform 200 is defined in the drive voltage range.

In addition, the above-described correction section 542 holds the drive voltage range and also controls the driven waveform for the correction in the drive voltage range.

Experimental Example

Herein, an example of the experiment method which determines the drive voltage range will be described. In order to determine the optimal drive voltage range as described above, it is known through various experiments that it is preferable to use a reference waveform having a process that changes the voltage from the first voltage and the second voltage having a voltage difference and a process that changes the voltage from the second voltage to the first voltage as illustrated in FIGS. 7 and 8, and to obtain a relationship between each voltage and the displacement when the voltage difference is made to be constant and the first voltage and the second voltage are supplied, being changed, and to set predetermined voltage range where the displacement is larger than a predetermined ratio as the drive voltage range using the relationship.

Figure 7:
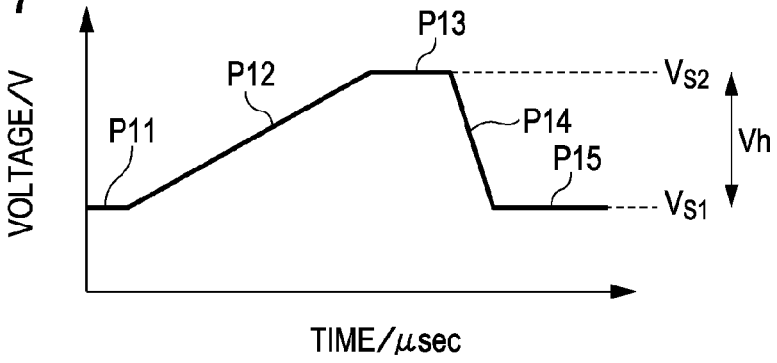
FIG. 7 is a view illustrating a reference waveform used in an experimental example.

The reference waveform illustrated in FIG. 7 includes a process P11 which holds $V_{s1}$ that is a first voltage, a first voltage change process P12 that relatively gradually changes a voltage from $V_{s1}$ that is the first voltage to $V_{s2}$ that is a second voltage, a holding process P13 that holds $V_{s2}$ that is the second voltage, a second voltage change process P14 which changes the voltage from $V_{s2}$ that is the second voltage to $V_{s1}$ that is the first voltage and a process P15 that holds $V_{s1}$ that is the first voltage. Like this, the reference waveform of FIG. 7 is a waveform of which the second voltage is relatively higher than the first voltage and the absolute value of difference between the first voltage and the second voltage is Vh.

Figure 8:
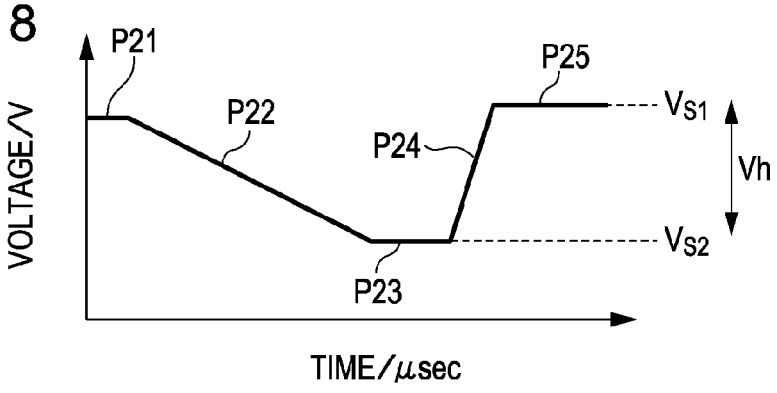
FIG. 8 is a view illustrating a reference waveform used in an experimental example.

The reference waveform illustrated in FIG. 8 includes a process P21 that holds $V_{s1}$ that is the first voltage, a first voltage change process P22 that relatively gradually changes the voltage from $V_{s1}$ that is the first voltage to $V_{s2}$ that is the second voltage, a holding process P23 that holds $V_{s2}$ that is a second voltage, a second voltage change process P24 that changes voltage from $V_{s2}$ that is the second voltage to $V_{s1}$ that is the first voltage and a process P25 that holds $V_{s1}$ that is the first voltage. Like this, the reference waveform of FIG. 8 is a waveform where the second voltage is relatively lower than the first voltage, and the absolute value of the difference between the first voltage and a second voltage is set to be Vh.

Figure 9:
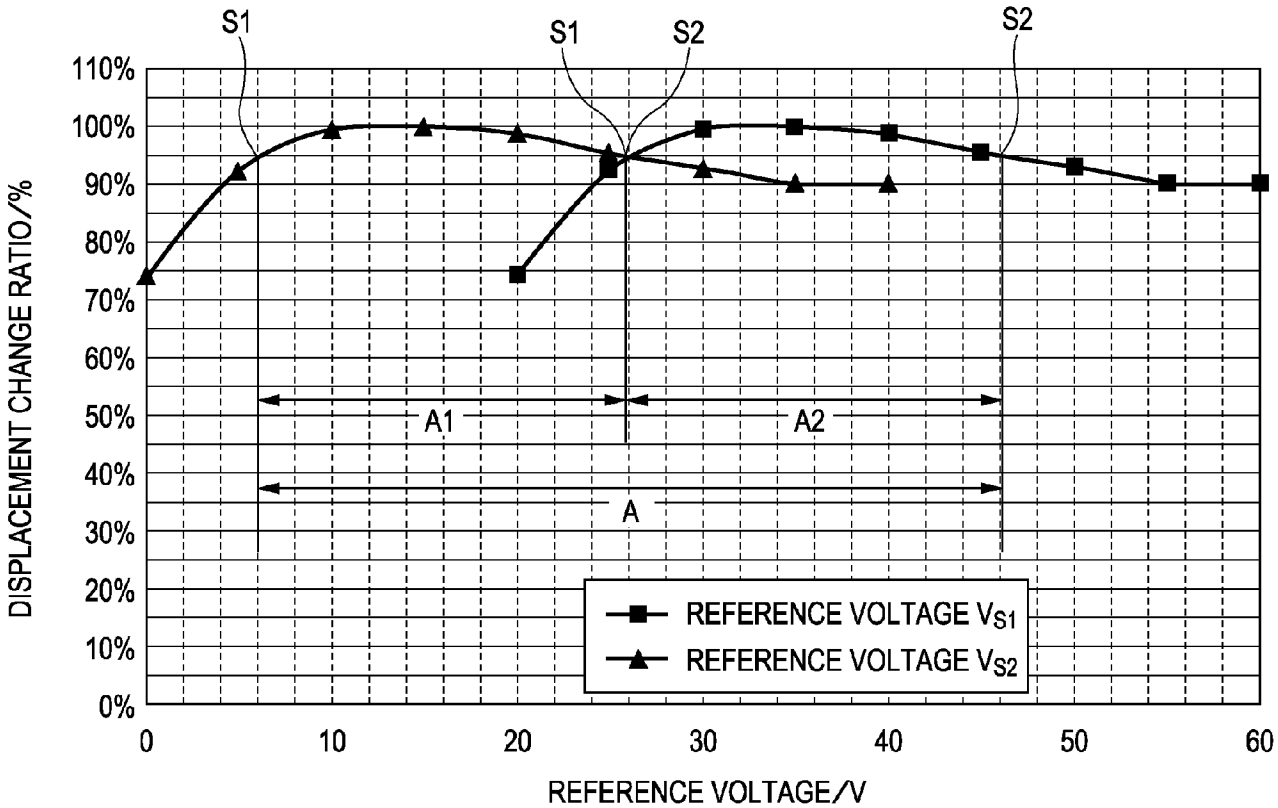
FIG. 9 is a view illustrating a result of an experimental example.

FIG. 9 is a graph illustrating the relationship between the displacement amount and $V_{s1}$ and $V_{s2}$ when the reference waveform illustrated in FIG. 7 is supplied by fixing the voltage difference to Vh=20V and changing $V_{s1}$ and $V_{s2}$. The displacement amount is illustrated such that the maximum value is 100%.

As illustrated in FIG. 9, when the displacement amount is changed depending on $V_{s1}$ and $V_{s2}$ and in particular, $V_{s1}$ and $V_{s2}$ are lower than the predetermined range, it is confirmed that the displacement amount is significantly reduced. In the embodiment, therefore, it is preferable that the threshold of the displacement amount be set to be 95%, $V_{s1}$ and $V_{s2}$ in a case where the threshold become becomes 95% with respect to the maximum displacement amount are respectively determined as a first threshold voltage S1 and a threshold second voltage S2 (two points of the first threshold voltage S1 and the second threshold voltage S2 are present each), the maximum range A of the first threshold voltage S1 and the second threshold voltage S2 is set to be a predetermined voltage range, the range is set to be the drive voltage range and the drive waveform defined within the drive voltage range may be preferably used. Herein, the fact that the drive waveform is defined within the drive voltage range, for example, means that $V_{s1}$ that is the first voltage is present within a threshold voltage range S1, that is, at the range $A_1$ and $V_{s2}$ that is the second voltage is present within the threshold voltage range S2, that is, at range A2 in the case of the drive waveform illustrated in FIG. 6. In addition, if such a drive waveform meets this condition, the voltage difference between $V_{s1}$ that is the first voltage and $V_{s2}$ that is the second voltage may be changed and it is preferable to set such a waveform to be the drive waveform for correction, for example.

Figure 10:
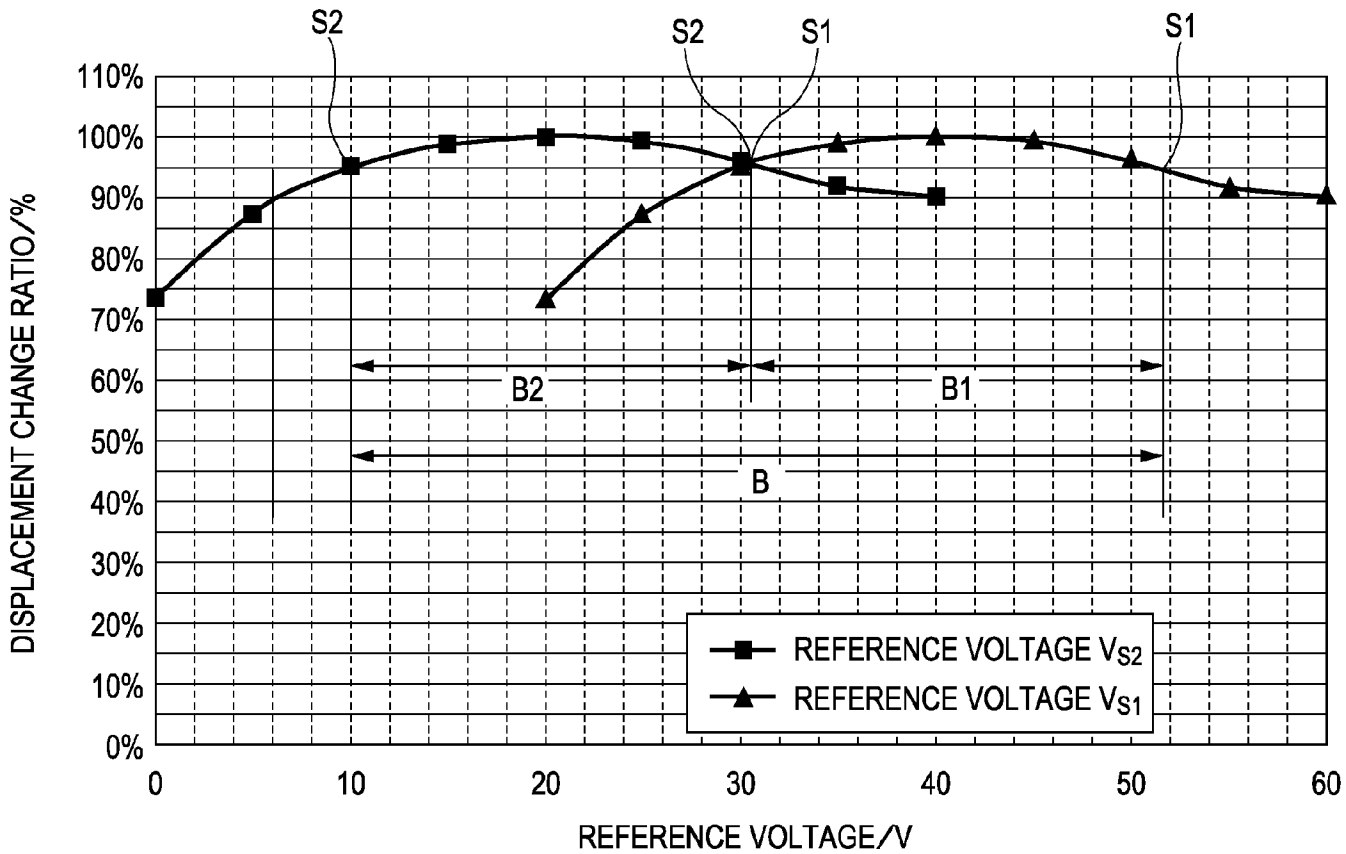
FIG. 10 is a view illustrating a result of an experimental example.

FIG. 10 is a graph illustrating a relationship between the displacement amount $V_{s1}$ and $V_{s2}$ when the reference waveform illustrated in FIG. 8 is supplied by fixing the reference waveform to be the voltage difference Vh=20 V and changing $V_{s1}$ and $V_{s2}$. The displacement amount is illustrated such that the maximum value is 100%.

Also in the case illustrated in FIG. 10, the displacement amount is changed depending on $V_{s1}$ and $V_{s2}$, in particular, when $V_{s1}$ and $V_{s2}$ are smaller than the predetermined range, it is confirmed that the displacement amount sufficiently is decreased. In addition, even in this case, the threshold of the displacement amount is set to be 95%, $V_{s1}$ and $V_{s2}$ in a case where the threshold of the displacement amount is set to 95% are respectively determined to be a first threshold voltage S1 and the second threshold voltage S2 (two points of the first threshold voltage S1 and the second threshold voltage S2 are present each), the maximum range B of the first threshold voltage S1 and the second threshold voltage S2 is set to be a predetermined voltage range, which can be set to be the drive voltage range. Herein, the fact that the drive waveform is defined within the drive voltage range, for example, means that the first voltage and the second voltage are set to be the drive waveform where the first voltage and the second voltage of the drive waveform illustrated in FIG. 6 are inverted, $V_{s1}$ that is the first voltage is present within the threshold voltage range S1, that is, within a range B1 and $V_{s2}$ that is the second voltage is present within the threshold voltage range S2, that is, within a range B2.

The test may be performed using any reference waveform illustrated in FIGS. 7 and 8, but both of them may be used to perform the test. When both tests are performed using both of them, it is possible to obtain a more stable displacement amount by setting the range A and the range B as the drive voltage range.

Other Embodiment

Hitherto, an embodiment of the invention has been described, but a basic configuration of the invention is not limited thereto. For example, the embodiment described above exemplifies a single silicon crystalline substrate as the flow path forming substrate 10, but without being limited thereto, for example, a SOI substrate, a material such glass and the like may be used.

Further, in the embodiment described above, the piezoelectric element 300 in which the first electrode 60, the piezoelectric layer 70 and the second electrode 80 are sequentially laminated on the substrate (the flow path forming substrate 10) is exemplified, but without being limited to thereto, for example, the invention may also be applied to a liquid ejecting apparatus having a longitudinal vibration type of the piezoelectric element which contracts the piezoelectric material and the electrode forming material in the axial direction by alternately laminating the piezoelectric material and the electrode forming material.

In addition, in each embodiment, the ink jet type recording head has been described as an example of the liquid ejecting head or the ink jet recording apparatus has been described as an example of the liquid ejecting apparatus. However, the invention is widely intended for a general liquid ejecting apparatus and of course may be applied to a liquid ejecting apparatus that ejects the liquid other than ink. Other liquid ejecting heads, for example, include various recording heads used in an image recording apparatus such as a printer, a color material ejecting head used in manufacturing a color filter such as a liquid crystal display and the like, an electrode material ejecting head used in forming an electrode such as an organic EL display, FED (field emission display), a bio-organic material ejecting head used in manufacturing a bio chip, and the invention may also be applied to a liquid ejecting apparatus having the related liquid ejecting jet heads.

What is claimed is:

1. A manufacturing method of a liquid ejecting apparatus which includes, a piezoelectric element that has a piezoelectric layer made of non-lead complex oxide and an electrode provided at the piezoelectric layer and a drive section that supplies a drive waveform driving the piezoelectric element to the piezoelectric element, the method comprising:

setting, as a drive voltage range for the drive waveform, a predetermined voltage range in which a displacement associated with the liquid ejecting apparatus is greater than a predetermined ratio, wherein setting the predetermined voltage range includes determining the predetermined voltage range from a relationship between first and second voltages, having a voltage difference, and the displacement by:

changing a reference waveform from the first voltage to the second voltage, changing the first voltage and the second voltage while maintaining the same voltage difference between the first voltage and the second voltage, changing the reference waveform from the changed first voltage to the changed second voltage, and determining the predetermined range according to the relationship between the first and second voltages and the displacement; and setting the drive waveform which the drive section supplies to the piezoelectric element as a drive waveform defined in a minimum voltage and a maximum voltage defined within a drive piezoelectric range.

* * * * *